United States Patent [19]

Kraft et al.

[11] 4,002,331

[45] Jan. 11, 1977

[54] FLAT MATERIAL FOLDING DEVICE

[76] Inventors: Brett W. Kraft; Barbara J. Porter, both of P.O. Box 7184, Country Club Station, Kansas City, Mo. 64113

[22] Filed: June 4, 1975

[21] Appl. No.: 583,622

[52] U.S. Cl. ..... 270/61 R; 270/61; 270/79

[51] Int. Cl.[2] ..... B65H 45/00

[58] Field of Search ..... 270/61 R–62, 270/68 R, 69, 81, 67; 223/37; 38/102.91, 102.3, 143; 53/21 R, 21 FW, 116, 120

[56] References Cited

UNITED STATES PATENTS

| | | | |
|---|---|---|---|
| 842,721 | 1/1907 | Sturterant | 270/81 |
| 3,419,261 | 12/1968 | Sjostrom | 270/69 |

*Primary Examiner*—Edgar S. Burr
*Assistant Examiner*—A. Heinz
*Attorney, Agent, or Firm*—Fishburn, Gold & Litman

[57] ABSTRACT

A flat material folding device is operative to fold flat material, such as napkins and the like, in a manner to have at least three folds extending transversely of the material and a center fold extending normal to the three folds. The folding device includes rollers positioned adjacent an entry for material to be folded to receive and move an intermediate portion of the flat material therebetween forming a first fold and moving the material along a folding path. A pair of laterally spaced arms and material grippers are on the path and receive respective side edge portions of the flat material spreading same and operable to move same along the path and form the second and third folds with respective portions of the material in face-to-face relation. A center folding device includes a pair of rollers engageable with a center portion of the material having the three transverse folds and operative to move the material therebetween to form the center fold extending normal to the three folds.

11 Claims, 12 Drawing Figures

FLAT MATERIAL FOLDING DEVICE

The present invention relates to material folding devices and more particularly to a folding device operative to fold flat fabric material, such as napkins, in a manner to have at least three folds extending transversely of the flat material and a center fold extending normal to the three folds.

The principal objects of the present invention are: to provide a flat material folding device operative to fold flat material, such as napkins and the like, in a manner to have at least three folds extending transversely of the flat material and a center fold extending normal to the three folds; to provide such a folding device which is automatic in operation thereby saving substantial time as compared to present hand folding methods; to provide such a folding device operative to effect sufficient tension in material being folded to substantially avoid wrinkles therein; to provide such a fabric folding device operative to accomodate variable dimensions and to provide uniformly folded items therefrom; to provide such a folding device including means to receive the folded items; to provide such a folding device wherein the operator's only function is to position flat material in a feeding position to start the folding operation with the folding device completing all folds and discharging uniformly folded items; and to provide such a folding device which is economical to manufacture, attractive in appearance, durable in construction, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the material folding device.

Figure 1:
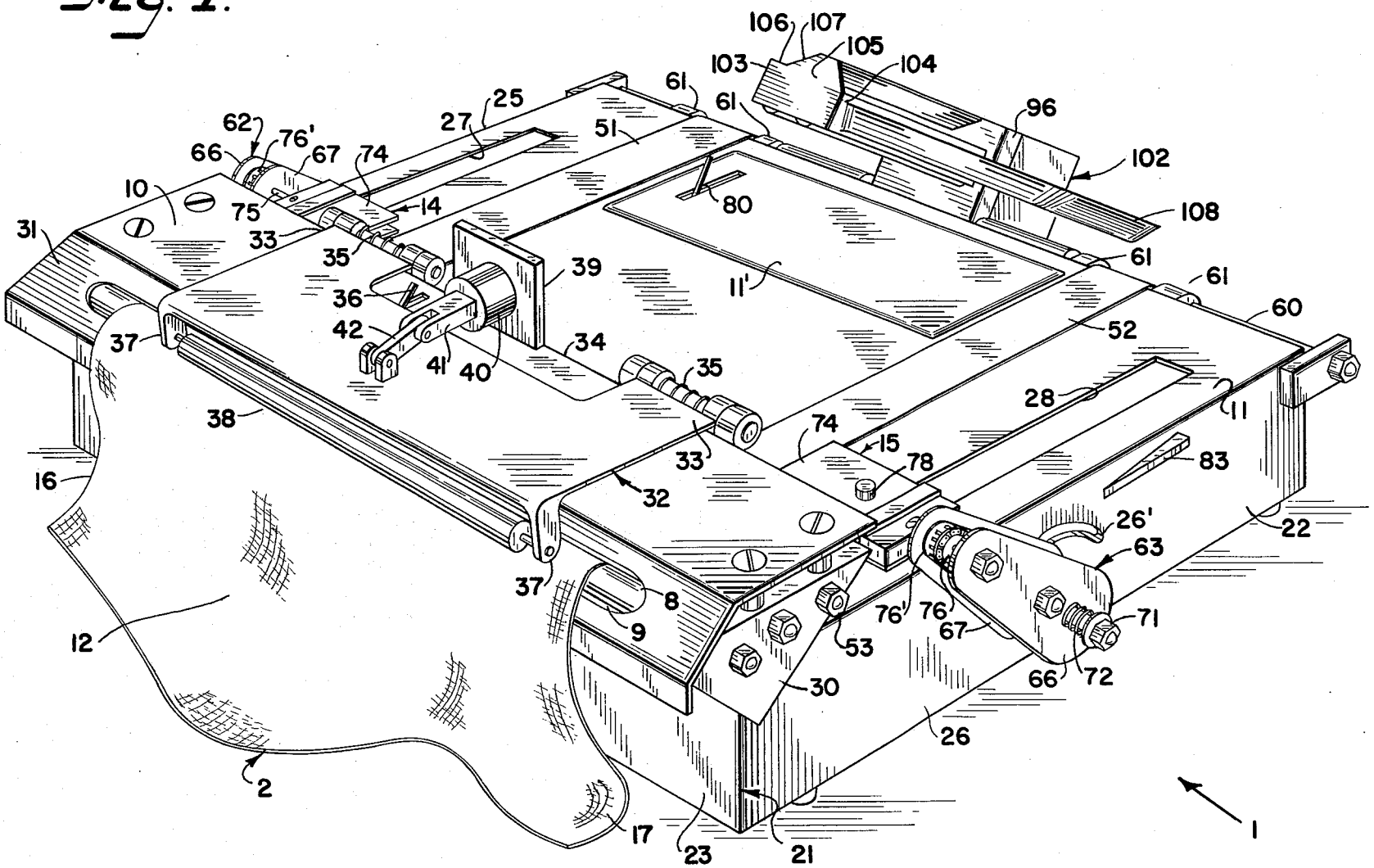
FIG. 1 is a perspective view of a flat material folding device embodying features of the present invention and showing flat material in position prior to folding.
Figure 2:
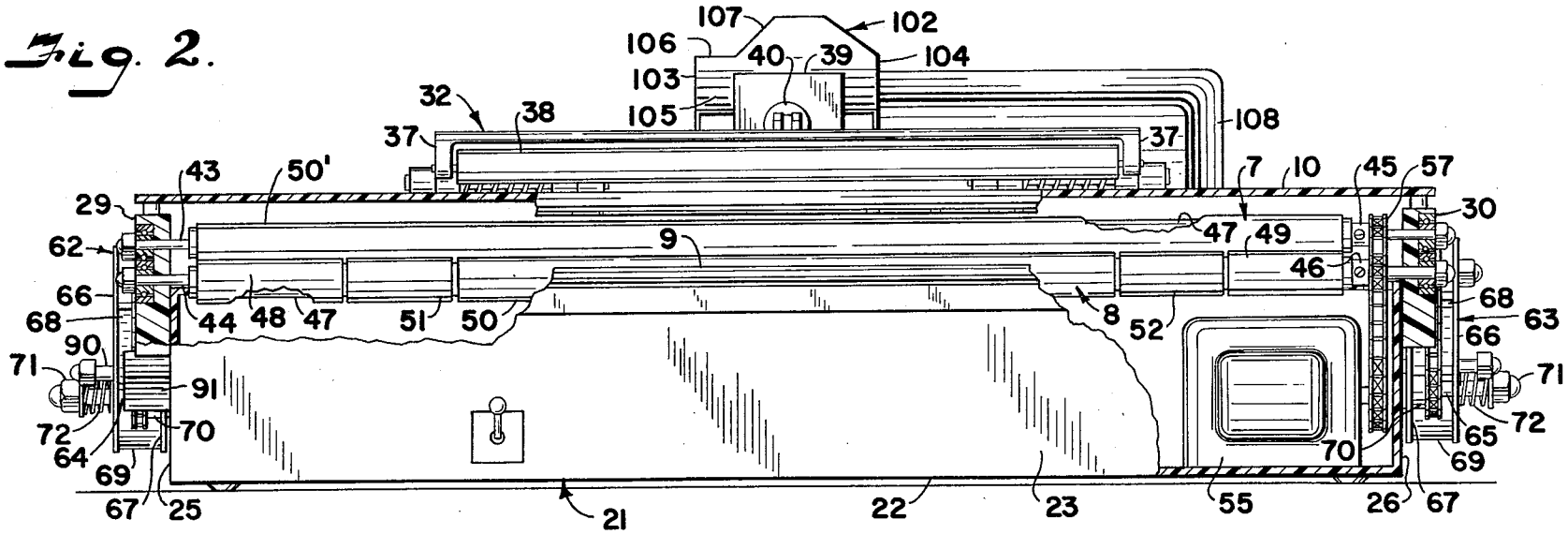
FIG. 2 is a front elevational view of the flat material folding device with portions broken away to better illustrate component parts.
Figure 6:
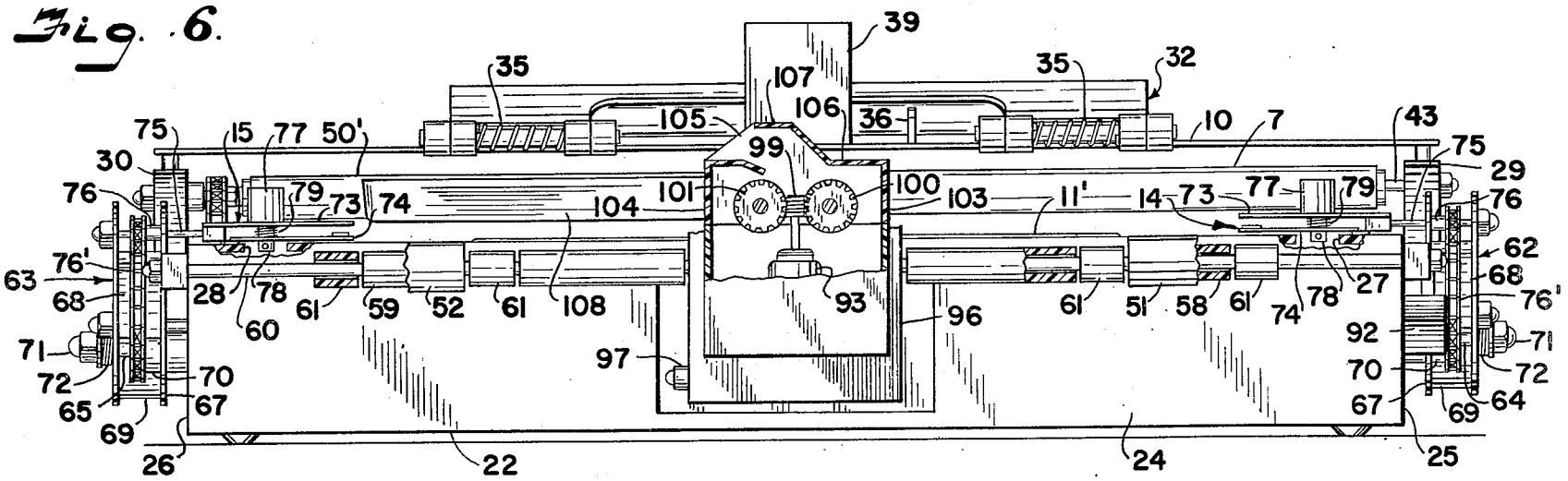
FIG. 6 is a rear elevational view of the folding device showing the center fold rollers in operative position.
Figure 3:
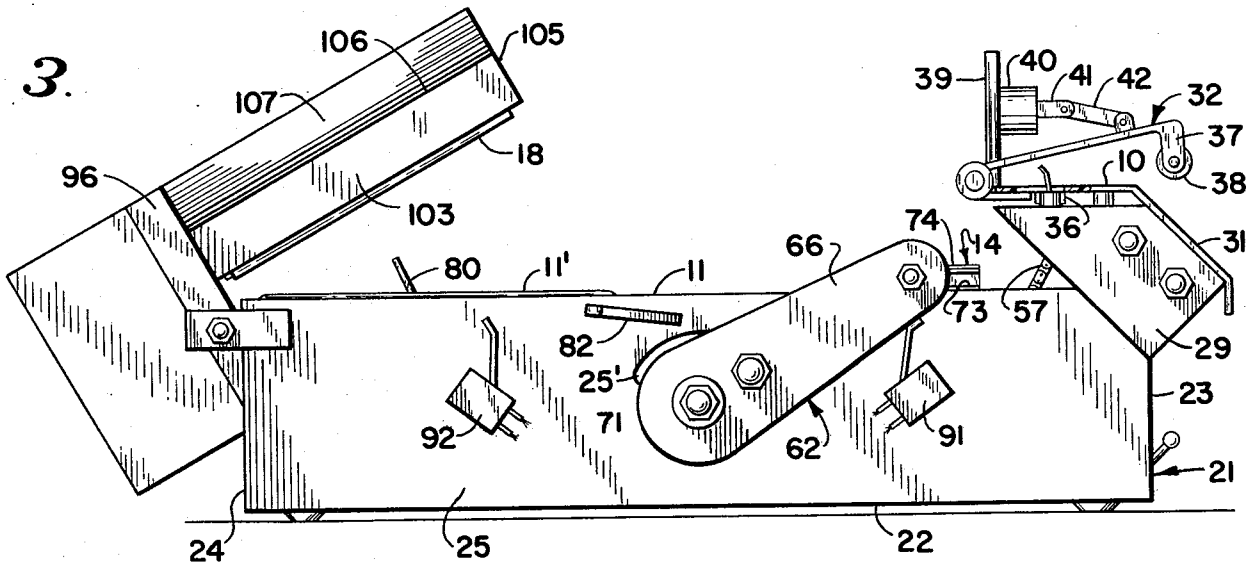
FIG. 3 is a side elevational view of one side of the folding device and with material grippers shown in a material receiving position.
Figure 12:
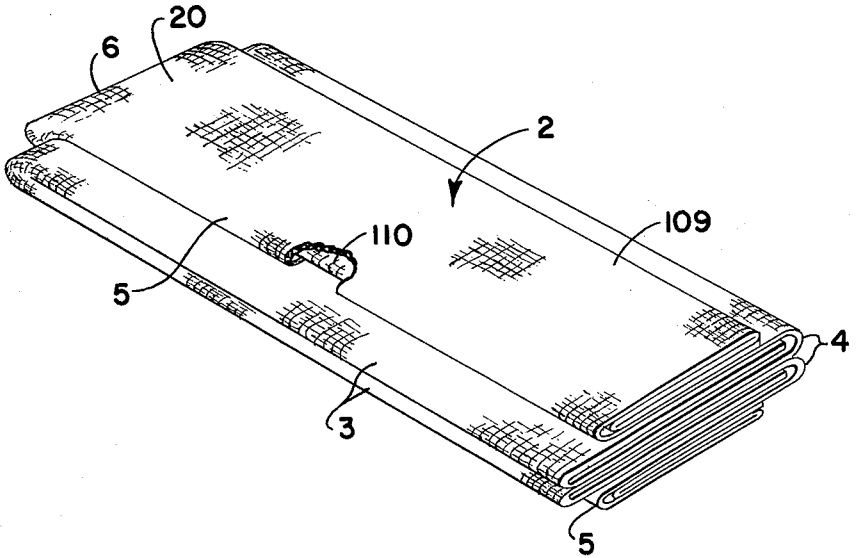
FIG. 12 is a perspective view of a folded item.
Figure 4:
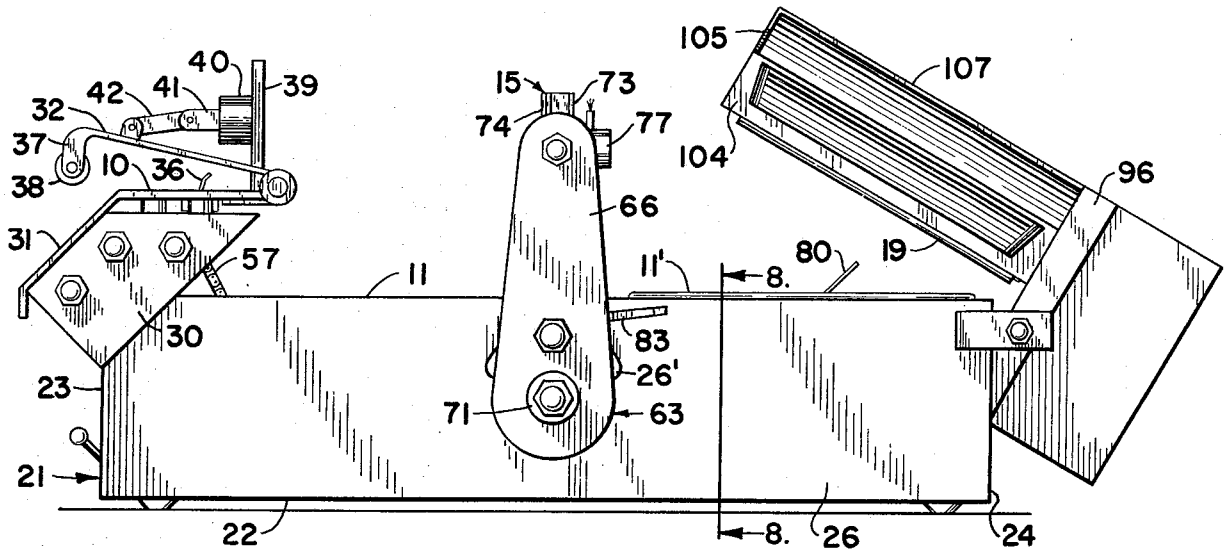
FIG. 4 is a side elevational view of the other side of the folding device and showing material grippers in an intermediate position.
Figure 5:
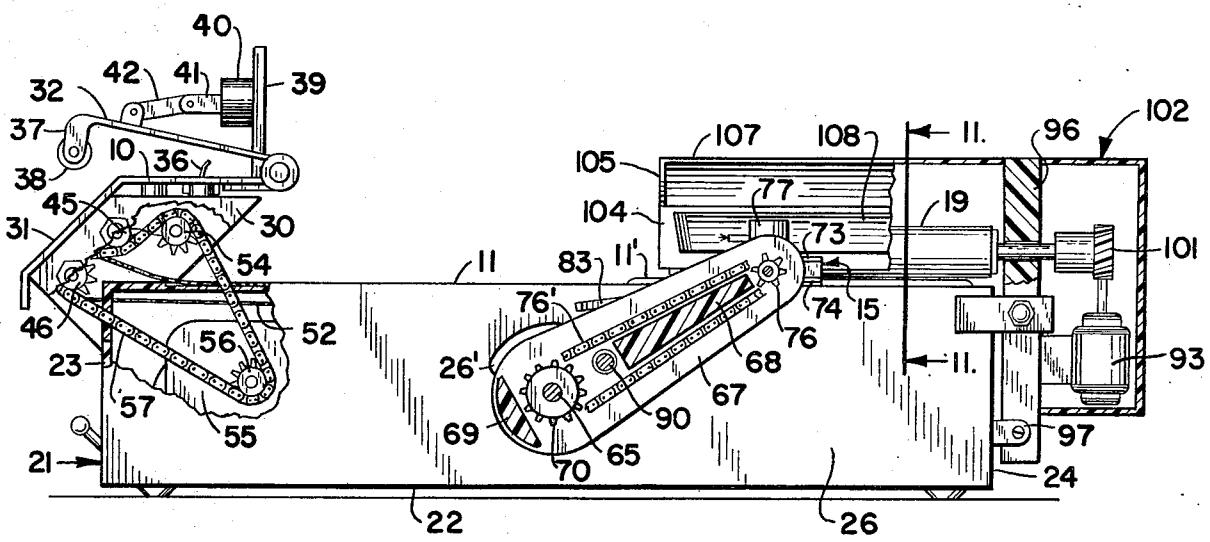
FIG. 5 is a side elevational view of the one side of the material folding device and showing the material grippers in a release position and center fold rollers in operative position.
Figure 7:
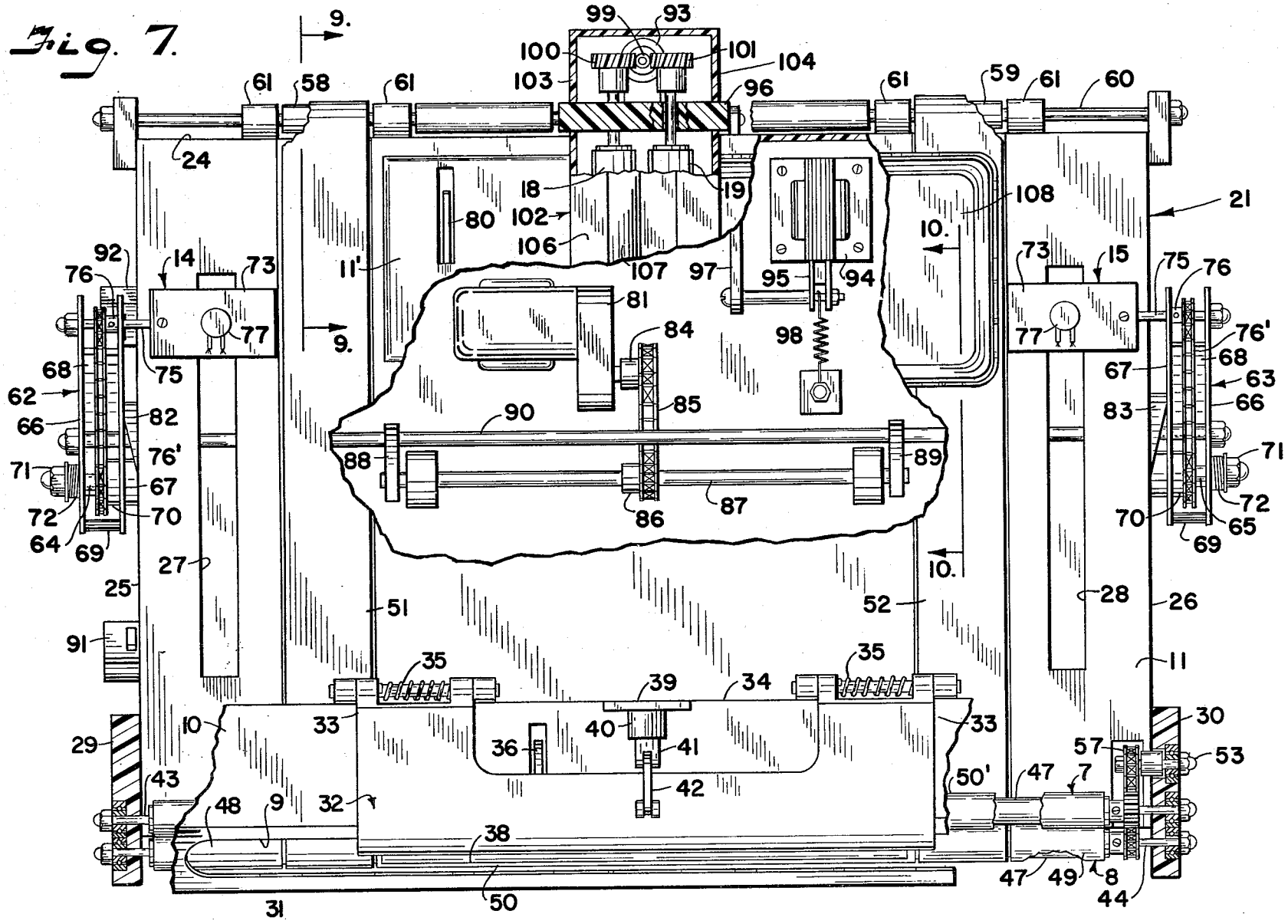
FIG. 7 is a top plan view with portions broken away to better illustrate the component parts.
Figure 8:
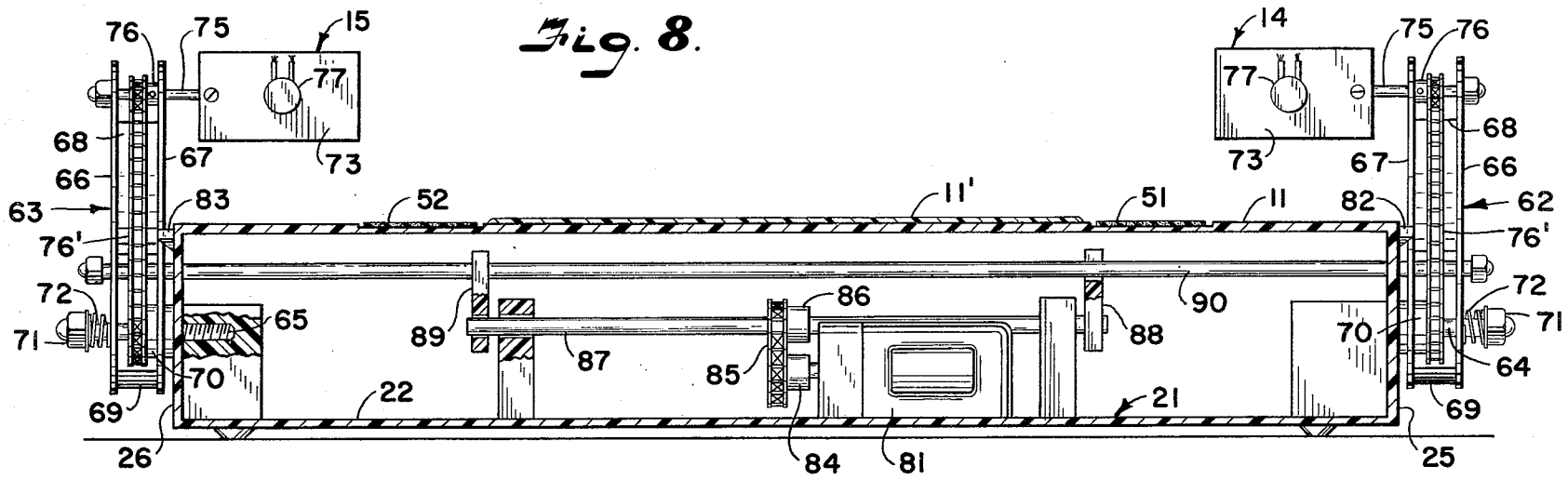
FIG. 8 is a transverse sectional view taken on line 8—8 of FIG. 4 and showing means for moving the material grippers between the material receiving position and the release position.
Figure 11:
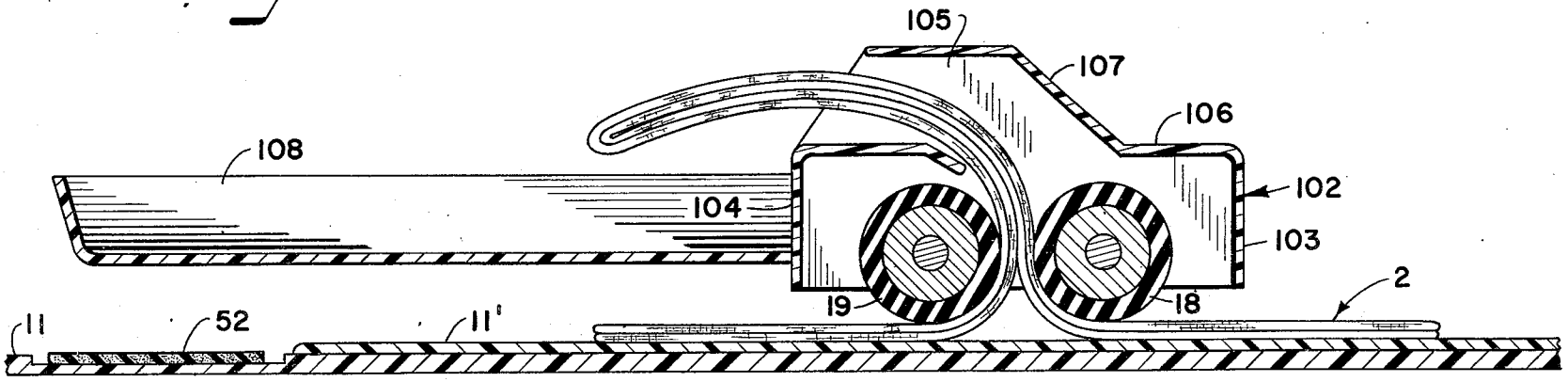
FIG. 11 is a transverse sectional view taken on line 11—11 of FIG. 5 and showing the center fold rollers in operative position.
Figure 9:
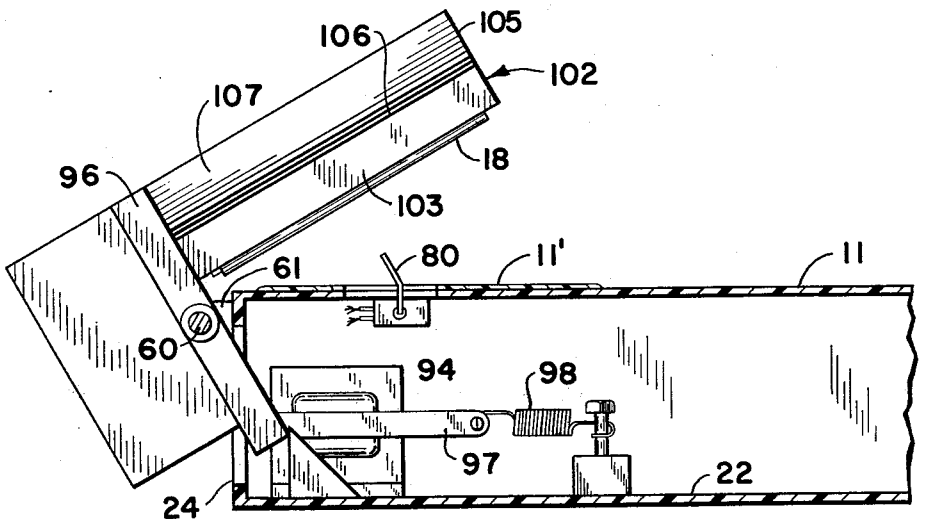
FIG. 9 is a longitudinal sectional view taken on line 9—9 of FIG. 7 and showing the drive structure for the center fold rollers.
Figure 10:
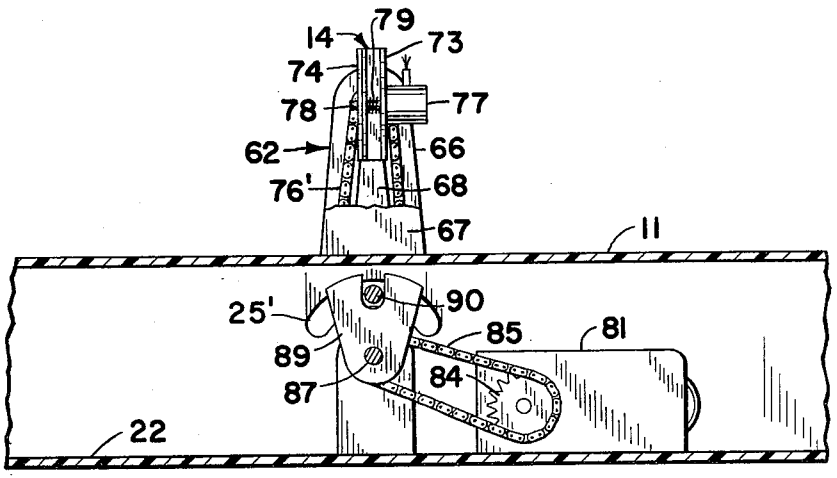
FIG. 10 is a longitudinal sectional view taken on line 10—10 of FIG. 7 and showing a drive for moving arms having the material grippers thereon.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in details to the drawings:

In the disclosed embodiment of the present invention, the reference numeral 1 designates generally a flat material folding device operative to fold flat material 2, particularly fabric items such as napkins or the like, in a manner to have suitable folds, as for example three folds, 3, 4, and 5 extending transversely of the flat material 2 and a center fold 6 extending normal to the three folds 3, 4, and 5. The folding device 1 includes material receiving and advancing members such as upper and lower entrance rollers 7 and 8 positioned adjacent an entrance 9 illustrated as positioned between a first or upper deck 10 and a second or lower deck 11 to move an intermediate portion 12 of the flat material 2 therebetween to form the first fold 3 and forward same along its folding path. The folding device 1 includes a pair of laterally spaced material grippers 14 and 15 for receiving respective side edge portions 16 and 17 of the flat material 2, spread same, and move same along the path to form the second fold 4 and the third fold 5 with respective portions of the material 2 in face-to-face relation. A suitable pickup and folding member, such as a pair of elongated rollers 18 and 19, is engageable with a center portion 20 of the flat material 2 having the three transverse folds 3, 4, and 5 and the rollers 18 and 19 are operative to move the material 2 therebetween to form the center fold 6 extending normal to the three folds 3, 4 and 5 and discharge the folded item to a suitable receiver.

The material folding device 1 includes a generally box-like housing 27 having a base 22 and front and rear walls 23 and 24.

The second or lower deck 11 is mounted on the front and rear walls 23 and 24 and on the side walls 25 and 26. A pair of longitudinally extending recesses 27 and 28 are formed in an upper surface of the second or lower deck 11 and the recesses 27 and 28 extend between the front and rear walls 23 and 24. The second or lower deck 11 has a raised portion 11 feet adjacent the rear edge thereof to receive the material 2 thereon for engagement by the center fold rollers 18 and 19.

Upwardly extending brackets 29 and 30 are mounted on front or forward end portions of the side walls 25 and 26 and extend upwardly therefrom to provide support for the first or upper deck 10 which is mounted on and extends between the brackets 29 and 30. A ramp 31 is inclined downwardly and outwardly from the upper deck 10 to support flat material 2 prior to folding. The ramp 31 has an aperture therein arranged to define the entrance 9 for moving the intermediate portion 12 of the flat material 2 therethrough.

To facilitate feeding the fabric item into the folder, a feed arm 32 has one end 33 thereof hingedly mounted on a rear edge portion 34 of the first or upper deck 10. The feed arm 32 includes a torsion spring 35 adapted to urge the feed arm 32 away from the upper deck 10 to permit an operator to move the flat material 2 onto the upper deck 10 and into engagement with a switch 36. The feed arm 32 may be of any desired shape and is shown generally L-shaped and with a depending portion 37 having a roller 38 mounted thereon. The roller 38 is movable into engagement with an intermediate portion 12 of the flat material 2 and is operative to move same into engagement with the entrance rollers 7 and 8.

A bracket 39 is mounted on a rear edge portion 34 of the upper deck 10. A solenoid 40 is mounted on the bracket 39 and includes a plunger or rod 41 movable outwardly therefrom upon completion of an electrical circuit in response to engagement of the switch 36 by the flat material 2. A link 42 has one end thereof pivotally connected to the rod 41 and the other end thereof pivotally connected to the feed arm 32 to thereby effect swinging movement thereof.

The entrance rollers 7 and 8 are mounted on elongated shafts 43 and 44 each having opposite ends thereof rotatably mounted on the side brackets 29 and 30 as in suitable bearings. The shafts 43 and 44 are suitably driven by transmission structure and in the illustrated form, it includes sprockets 45 and 46 mounted on the elongated shafts 43 and 44. Each of the entrance rollers 7 and 8 have a body portion 47. The lower roller 8 has material engaging sleeve portions thereon arranged as opposite end portions 48 and 49 and a center portion 50. The upper roller 7 has a sleeve portion 50 feet thereon. The lower entrance roller 8 includes a pair of recesses defined by spaces between the opposite ends of the center portion 50 and adjacent ends of the end portions 48 and 49 for receiving a pair of endless belts 51 and 52 respectively.

An idler 53 is positioned adjacent the shafts 43 and 44 and includes a shaft having at least one of the ends thereof mounted on one of the side brackets 29 and 30. A sprocket 54 is mounted on the shaft of the idler 53 and the sprocket 54 is in alignment with sprockets 45 and 46.

The entrance rollers 7 and 8 are turned in opposite directions to move the intermediate portion 12 of the flat material 2 therebetween and form the first fold 3. Any suitable drive and speed transmission structure may be used in the various portions of the apparatus and in the illustrated structure, a drive motor 55 is supported on the base 22 and is operative to rotate a drive sprocket 56. An endless chain 57 extends around the drive sprocket 56, over and around a sprocket 46 on the lower roller shaft 44, and under the sprocket 45 on the upper roller shaft 43 and then over the sprocket 54 on the shaft of the idler 53 to thereby tighten the endless chain 57.

The material engaging sleeve portions of the entrance rollers 7 and 8 are preferably formed of surgical rubber or other resilient frictional material that has an adhesive tendency which aids in moving the fabric 2 therebetween.

The endless belts 51 and 52 receive the material 2 from the entrance rollers 7 and 8. The belts 51 and 52 move the material toward the center-fold rollers 18 and 19. The endless belts 51 and 52 each extend around the lower entrance roller 8 adjacent the front edge of the second or lower deck 11 and around idler rollers 58 and 59 adjacent a rear edge of the lower deck 11. The idler rollers 58 and 59 are mounted on a shaft 60 supported on the rear wall 24 of the housing 21. In the illustrated structure, the shaft 60 is supported on a plurality of spaced brackets 61 extending rearwardly from the rear wall 24 of the housing 21. The brackets 61 are arranged at opposite ends of the idler rollers 58 and 59 to define guides for the belts 51 and 52.

The material grippers 14 and 15 receive portions of the flat material and are moved to cause some of said material to overlie other portions thereof providing a desired fold. In the structure illustrated, the movement forms second and third folds 4 and 5 extending transversely of the flat material 2 whereby a plurality of respective portions of the flat material 2 are folded to be in face-to-face relation. In the illustrated structure, the grippers are carried by a pair of arms 62 and 63 which are positioned adjacent the side walls 25 and 26 of the housing 21. The arms 62 and 63 each have one end thereof mounted on respective shafts 64 and 65 extending from the side walls 25 and 26 providing an axis for swinging movement of said arms. The grippers 14 and 15 are rotatably carried by the arms and are operatively associated so the grippers have a selected rotative movement as the arms swing in their respective paths. The arms 62 and 63 each include a pair of planar members 66 and 67 with upper and lower spacers 68 and 69 therebetween. The shafts 64 and 65 each have a sprocket 70 sleeved thereon. The sprocket 70 is positioned between the planar members 66 and 67 of the respective arms. Each of the shafts 64 and 65 have an enlarged end portion 71 spaced from the respective arm. A resilient member 72 is sleeved on each of the shafts 64 and 65 and extends between the respective arm and the respective enlarged end portion 71 to thereby urge the arms toward the respective side walls of the housing 21.

The illustrated grippers 14 and 15 each include a pair of planar members 73 and 74 normally positioned in spaced apart relation when the arms are in a first position adjacent the front edge of the lower deck 11 to permit moving of the side edge portions 16 and 17 of the flat material 2 therebetween. The grippers 14 and 15 each include a mounting shaft 75 rotatably mounted on the other end of the respective arms 62 and 63 and having the respective pair of planar members 73 and 74 mounted thereon. The mounting shafts 75 are each rotatably mounted on the arms 62 and 63 and have a sprocket 76 mounted thereon.

An endless flexible chain 76 feet extends around the fixed sprocket 70 and around the sprocket 76 on the mounting shaft 75 whereby movement of the arms 62 and 63 about the shafts 64 and 65 effects turning of the grippers 14 and 15 in a direction opposite to the direction of movement of the arms and through one hundred eighty degrees (180°).

Power means are operatively connected to at least one of the pair of opposed planar members 73 and 74 to selectively effect movement thereof toward and away from the other planar members. In the illustrated structure, a suitable solenoid 77 is mounted on one of the planar members, for example member 73. The solenoid 77 includes a plunger or rod 78 extending through the other planar member 74. A suitable keeper is mounted on the other end of the rod 78 and is in engagement with the planar member 74. In the illustrated structure, the plunger 78 is bifurcated and has a nut between spaced arms and a threaded stud extends through the arms and through the nut. A suitable resilient member 79 is positioned between the planar members 73 and 74 and sleeved on the rod 78 to thereby urge same apart except when moved into clamping engagement by the solenoid 77.

The solenoid 77 is electrically connected to a switch 80 positioned adjacent the center-fold rollers 18 and 19. The switch 80 is positioned on a rear edge portion of the lower deck 11 and preferably on the raised portion 11 feet thereof. The switch 80 is operative in response to contact by the leading portion of a member being folded to open an electrical circuit to the drive motor 55 thereby stopping same and the entrance rollers 7 and 8 and the endless belts 51 and 52. The switch 80 also completes an electrical circuit to a reversible drive motor 81 operative to move the arms 62 and 63 and the material grippers 14 and 15 thereon.

The arms 62 and 63 each have a first or forward position with the grippers 14 and 15 positioned adjacent a front edge portion of the lower deck 11 and adjacent the entrance rollers 7 and 8 and a second position with the grippers 14 and 15 adjacent a rear edge portion of the lower deck 11. The arms 62 and 63 are moved outwardly from the side walls 25 and 26 of the housing 21 during movement from the first position to the second position thereby effecting tension in the flat material 2 during forming of the second and third folds 4 and 5. In the illustrated structure, ramp members 82 and 83 are mounted on and extend outwardly from the side walls 25 and 26 respectively of the housing 21 and are engaged by the arms 62 and 63 during movement thereof.

The drive motor 81 is mounted on the base 22 and is operative to rotate a drive sprocket 84. An endless chain 85 extends around the drive sprocket 84 and around a sprocket 86 on an elongated driven shaft 87 having opposite end portions thereof rotatably mounted on suitable supports upstanding from the base 22.

Bifurcated levers 88 and 89 are fixedly mounted on opposite ends of the driven shaft 87 and the levers 88 and 89 have an elongated rod received therein and extending therethrough and substantially parallel with the driven shaft 87 and substantially perpendicular to the levers 88 and 89. Opposite end portions of the rod 90 extend through the side walls 25 and 26 and through the arms 62 and 63 respectively whereby rotation of the driven shaft 87 moves the rod 90 in an arcuate path, therefore, the side walls 25 and 26 each have arcuate slot 25' and 26' respectively therein with respective end portions of the rod 90 extending therethrough.

A first limit switch 91 is mounted on one of the side walls of the housing adjacent the front edge of the lower deck 11. The first limit switch 91 is normally closed and is engaged by one of the arms when in the first position and engagement thereby opens the switch 91 and breaks an electrical circuit to the solenoids 77 for the grippers 14 and 15. Disengagement by the one arm with the first limit switch 91 allows same to close and complete an electrical circuit to the solenoids 77 thereby effecting clamping engagement of the planar members 73 and 74 with the respective side edge portions 16 and 17 of the material 2.

A second limit switch 92 is positioned adjacent the rear edge of the lower deck 11 and engagement by the one arm breaks an electrical circuit to the solenoids 77 thereby releasing the grippers 14 and 15. Engagement of the one arm with the second limit switch 92 activates a drive motor 93 for the center-fold rollers 18 and 19.

The switch 92 also completes an electrical circuit to a suitable solenoid 94 upon engagement thereof by the material 2. The solenoid 94 is operative to move a plunger 95 connected to a support member 96 which is pivotally mounted on the elongated shaft 60 and having the drive motor 93 mounted thereon. In the illustrated structure, the plunger 95 has one end thereof pivotally connected to a link 97 having the other end thereof pivotally connected to the support member 96. A resilient member 98 is connected to the plunger 95 and is operative to return the support member 96 to an inclined position.

The drive motor 93 is connected through a speed reducer to the rollers 18 and 19 to drive same. In the illustrated structure the motor 93 is operative to rotate a worm gear 99 which is in engagement with helical gears 100 and 101 on one end of the rollers 18 and 19. The rollers 18 and 19 thereby rotate in opposite directions to pull the center portion 20 of the material 2 upwardly therebetween and form the center fold 6. The rollers 18 and 19 are mounted on shafts positioned to define a very small acute angle therebetween whereby free ends of the rollers 18 and 19 move in circular paths while moving the center portion 20 of the material 2 therebetween. This increases pressure of the rollers on the fabric material and aids in the rollers picking up the center portion 20. The rollers 18 and 19 are preferably provided with sleeves 19' of surgical rubber or other resilient frictional material that has an adhering tendency which further aids in assuring the pick up and movement of the center portion 20 between the rollers 18 and 19 to form the center fold.

The center fold rollers 18 and 19 preferably are enclosed within an enclosure 102 mounted on the support member 96. The illustrated enclosure 102 has side walls 103 and 104 and an end wall 105 positioned adjacent free ends of the rollers 18 and 19. The enclosure 102 includes a top wall 106 having an aperture therein to permit folded material to move therethrough. A deflector 107 is mounted on and extends upwardly and outwardly from the top wall 106 and toward one of the side walls of the enclosure 102.

A receiving tray or receptacle 108 is mounted on one of the side walls of the enclosure 102 and positioned to catch the folded material after engagement thereof with the deflector 107. The tray 108 is preferably sized to store a plurality of folded items.

Movement of the fabric or flat material 2 through the folding device 1 includes positioning one edge of the material 2 in engagement with the switch 36. The first fold 3 is formed by moving the intermediate portion 12 between the entrance rollers 7 and 8. The second and third folds 4 and 5 are formed by movement of the arms 62 and 63 from adjacent the entrance rollers 7 and 8 to adjacent the center fold rollers 18 and 19. The second fold 4 is formed adjacent the one edge of the material 2 and the third fold 5 is formed adjacent the first fold 3. Turning of the grippers 14 and 15 forms a fourth fold 109 which is positioned adjacent and above the second fold 4. Depending on the length of material 2, a fifth fold 110 may be formed by a portion of the material engaging the portion of the material between the second and third folds 4 and 5 during turning of the grippers 14 and 15 and movement of the arms 62 and 63. The fifth fold 110 would be positioned between the third fold 5 and the fourth fold 109.

In using a material folding device constructed as illustrated and described, an operator moves one edge of the flat material 2 into engagement with the switch 36 which completes an electrical circuit to the solenoid 40 which moves the roller 38 into engagement with the intermediate portion 12 of the material 2. The entrance rollers 7 and 8 move the intermediate portion 12 through the entrance 9 and between the rollers 7 and 8 to form the first fold 3. The endless belts 51 and 52 move the first fold into engagement with the switch 80 thereby breaking the circuit to the drive motor 55 which stops the rollers 7 and 8 and the endless belt 51 and 52. The switch 80 completes respective electrical circuits to the drive motor 81 and to the solenoids 77. The solenoids 77 effect clamping engagement of the side edge portions 16 and 17 of the flat material 2 by the grippers 14 and 15. The drive motor 81 moves the arms 62 and 63 from the front edge portion toward the rear edge portion of the lower deck 11 thereby forming the second and third folds 4 and 5. When one of the arms is out of engagement with the first limit switch 91, the solenoids 77 are activated to effect the clamping engagement. When the one arm engages the second limit switch 92, an electrical circuit to the solenoids 77 is broken and an electrical circuit to the solenoid 94 is completed to move the support member 96 and the center fold rollers 18 and 19 to the operative position. The drive motor 93 is also activated to rotate the center fold rollers 18 and 19 to form the center fold 6 and move the folded items into the tray 108 where same are removed by the operator.

It is to be understood that while we have illustrated and described one form of our invention, it is not to be limited to the specific form or arrangement of parts herein described and shown.

What we claim and desire to secure by Letters Patent is:

1. An apparatus for folding napkins and the like and comprising:

a. a housing having an entrance for napkins to be folded, said napkins having opposed ends and opposed sides;

b. napkin advancing means adjacent said entrance for receiving and engaging an intermediate portion between ends of a napkin forming a fold and advancing the napkin along a path with said fold being a leading fold edge thereof and the napkin sides being adjacent sides of said path;

c. means on said housing and positioned in the napkin path and engageable by said leading fold edge of the napkin and operative to stop the advancing movement thereof;

d. gripper means movably mounted relative to said housing and operative to engage and grip portions adjacent said opposed sides of the napkin in spaced relation to said leading fold edge thereof and to move portions of the napkin between said gripper means forwardly relative to said path into folded overlying relation to napkin portions adjacent said leading fold edge and then release said side portions;

e. folding means engageable with the folded overlying napkin portions at a central portion between the napkin sides and operative to move said central portion transversely to form a transverse fold in the napkin; and means on said housing cooperating with said gripper means for urging same laterally outwardly relative to the napkin path to tension the napkin portions between said gripper means.

2. An apparatus for folding napkins and the like and comprising:

a. a housing having an entrance for napkins to be folded, said napkins having opposed ends and opposed sides;

b. napkin advancing means adjacent said entrance for receiving and engaging an intermediate portion between ends of a napkin forming a fold and advancing the napkin along a path with said fold being a leading fold edge thereof and the napkin sides being adjacent sides of said path;

c. means on said housing and positioned in the napkin path and engageable by said leading fold edge of the napkin and operative to stop the advancing movement thereof;

d. gripper means movably mounted relative to said housing and operative to engage and grip portions adjacent said opposed sides of the napkin in spaced relation to said leading fold edge thereof and to move portions of the napkin between said gripper means forwardly relative to said path into folded overlying relation to napkin portions adjacent said leading fold edge and then release said side portions, said gripper means comprises:

1. a pair of arms each positioned adjacent a respective one of the opposite side portions of said housing and having one end thereof pivotally mounted thereon;

2. means operatively connected to each of said arms for moving the other end thereof between a first position adjacent the front portion of said housing and a second position adjacent the rear portion of said housing;

3. napkin holding means for and mounted on the other end of each of said arms for selectively clamping and releasing a respective side edge portion of the napkin; and 4. means mounted on each of said arms and operatively connected to each of said napkin holding means for turning same during movement of said arms between the first and second positions and in a manner to move a plurality of the respective portions of the napkin into face-to-face relation; and e. folding means engageable with the folded overlying napkin portions at a central portion between the napkin sides and operative to move said central portion transversely to form a transverse fold in the napkin.

3. A flat material folding device comprising:

a. a housing having a first deck and a second deck and an entrance therebetween, said first deck being above said second deck and adapted to receive flat material thereon, said second deck having a front edge and a rear edge and opposite side edges;

b. means mounted on said housing for moving an intermediate portion of the flat material into the entrance between the first deck and second deck;

c. means adjacent the front edge of said second deck for receiving an intermediate portion of the flat material and moving same from said first deck and through the entrance and over said second deck in a manner to form a first fold extending transversely of the flat material, said means for moving an intermediate portion of the flat material over said second deck includes a plurality of endless belts each movable in an endless path around the front edge and rear edge of said second deck;

d. means mounted on said housing and positioned adjacent the opposite side edges of said second deck for receiving the flat material and moving same to form at least second and third folds extending transversely of the flat material whereby a plurality of respective portions of the flat material are folded to be in face-to-face relation; said means for receiving and moving the flat material to form the second and third folds includes:

1. a pair of arms each positioned adjacent a respective one of the opposite side edges of said second deck, said arms each having one end thereof pivotally mounted on said housing and movable between a first position with the other end thereof adjacent the front edge of said second deck;
2. material holding means for and mounted on the other end of each of said arms for selectively clamping and releasing a respective side edge portion of the flat material; and
3. means mounted on each of said arms and operatively connected to said respective material holding means for turning same during movement of said arms between the first and second positions and in a manner to move a plurality of the respective portions of the flat material to side-by-side relation; and e. means mounted on said housing and positioned adjacent the rear edge of said second deck for engaging a center portion of the flat material having said first and second and third folds and moving same to form a center fold extending normal to the first and second and third folds and moving same to form a center fold extending normal to the first and second and third folds, said means for engaging and moving a center portion of the flat material to form a center fold includes:

1. a pair of adjacent elongated rollers and means for rotatably mounting same for movement between a first position spaced from said second deck and a second position extending substantially normal to the rear edge of said second deck and in engagement with a center portion of the flat material having said first and second and third folds; and
2. means operatively connected to said pair of adjacent rollers for turning same to move the flat material therebetween to form the center fold.

4. A flat material folding device as set forth in claim 3 wherein:

a. said means for receiving an intermediate portion of the flat material and moving same through the entrance includes:

1. a pair of adjacent elongated rollers positioned adjacent the front edge of said second deck; and
2. means operatively connected to said pair of rollers for turning same to move the intermediate portion of the flat material therebetween to form the first fold;

b. said material holding means for selectively clamping and releasing a respective side edge portion of the flat material each comprise:

1. a pair of opposed planar members normally positioned in spaced apart relation when said respective arm is in the first position adjacent the front edge of said second deck to permit the respective side edge portion of the flat material to move therebetween;
2. means operatively engaging at least one of said pair of opposed planar members to selectively effect movement of the one planar member toward and away from the other planar member; and
3. a mounting shaft rotatably mounted on said other end of said respective arm and having said respective pair of planar members mounted thereon; and c. said means for turning each of said material holding means comprises:

1. a first sprocket fixedly mounted on said housing;
2. a second sprocket fixedly mounted on said respective mounting shaft; and
3. an endless flexible chain extending around said first sprocket and said second sprocket whereby movement of said arm effects turning of said respective pair of opposed planar members in a direction opposite to the direction of movement of said arm.

5. An apparatus for folding napkins and the like and comprising:

a. a housing having an entrance for napkins to be folded, said housing having a front portion and a rear portion and opposite side portions, said entrance being positioned adjacent the front portion of said housing;

b. napkin advancing means adjacent said entrance for receiving and engaging an intermediate portion of a napkin forming a fold and advancing the napkin along a path with said fold being a leading fold edge thereof, said napkin advancing means comprising:

1. a pair of adjacent elongated rollers positioned adjacent the front portion of said housing and operative to move an intermediate portion of the napkin therebetween to form a first fold defining the leading fold edge of the napkin; and
2. a plurality of laterally spaced endless belts each movable in an endless path between the front portion and the rear portion of said housing;

c. means on said housing and positioned in the napkin path and engageable by said leading fold edge of the napkin and operative to stop the advancing movement thereof;

d. gripper means movably mounted relative to said housing and operative to engage and grip opposed side portions of the napkin in spaced relation to said leading fold edge thereof and to move portions of the napkin between said gripper means forwardly relative to said path into folded overlying relation to napkin portions adjacent said leading fold edge and then release said side portions, said gripper means comprising:

1. a pair of arms each positioned adjacent a respective one of the opposite side portions of said housing and having one end thereof pivotally mounted thereon;
2. means operatively connected to each of said arms for moving the other end thereof between a first position adjacent the front portion of said housing and a second position adjacent the rear portion of said housing:
3. napkin holding means for and mounted on the other end of each of said arms for selectively clamping and releasing a respective side edge portion of the napkin;

4. means mounted on each of said arms and operatively connected to each of said napkin holding means for turning same during movement of said arms between the first and second positions and in a manner to move a plurality of the respective portions of the napkin into face-to-face relation; and e. folding means engageable with the folded overlying napkin portions intermediate the side portions and operative to move the intermediate portion transversely to form a transverse fold in the napkin.

6. A flat material folding device comprising:

a. a housing having a first deck and a second deck and an entrance therebetween, said first deck being above said second deck and adapted to receive flat material thereon, said second deck having a front edge and a rear edge and opposite side edges;

b. means adjacent the front edge of said second deck for receiving an intermediate portion of the flat material and moving same from said first deck and through the entrance and over said second deck in a manner to form a first fold extending transversely of the flat material;

c. means mounted on said housing and positioned adjacent the opposite side edges of said second deck for receiving and gripping opposed side portions of the flat material and operative to move the portion of the flat material therebetween toward the rear of said second deck into overlying relation with the flat material adjacent said first fold to form at least second and third folds extending transversely of the flat material whereby a plurality of respective portions of the flat material are folded to be in face-to-face relation, said means for receiving the flat material and moving same to form at least second and third folds comprising:

1. a pair of arms each positioned adjacent a respective one of the opposite side edges of said second deck, said arms each having one end thereof pivotally mounted on said housing:

2. means operatively connected to each of said arms for selectively moving the other end thereof between a first position adjacent the front edge of said second deck and a second position adjacent the rear edge of said second deck;

3. material holding means for and mounted on the other end of each of said arms for selectively clamping and releasing a respective side edge portion of the flat material;

4. means mounted on each of said arms and operatively connected to said respective material holding means for turning same during movement of said arms between the first and second positions and in a manner to move a plurality of the respective portions of the flat material into face-to-face relation; and d. means mounted on said housing and positioned adjacent the rear edge of said second deck for engaging a center portion of the flat material having said first and second and third folds and moving same to form a center fold extending normal to the first and second and third folds.

7. A flat material folding device as set forth in claim 6 wherein:

a. said material holding means for selectively clamping and releasing a respective side edge portion of the flat material each comprise:

1. a pair of opposed planar members normally positioned in spaced apart relation when said respective arm is in the first position adjacent the front edge of said second deck to permit the respective side edge portion of the flat material to move therebetween;

2. means operatively engaging at least one of said pair of opposed planar members to selectively effect movement of the one planar member toward and away from the other planar member; and 3. a mounting shaft rotatably mounted on said other end of said respective arms and having said respective pair of planar members mounted thereon; and b. said means for turning each of said material holding means comprises:

1. a first sprocket fixedly mounted on said housing;

2. a second sprocket fixedly mounted on said respective mounting shaft; and 3. an endless flexible chain extending around said first sprocket and said second sprocket whereby movement of said arm effects turning of said respective pair of opposed planar members in a direction opposite to the direction of movement of said arm.

8. A flat material folding device comprising:

a. a housing having a first deck and a second deck and an entrance therebetween, said first deck being above said second deck and adapted to receive flat material thereon, said second deck having a front edge and a rear edge and opposite side edges;

b. means adjacent the front edge of said second deck for receiving an intermediate portion of the flat material and moving same from said first deck and through the entrance and over said second deck in a manner to form a first fold extending transversely of the flat material;

c. means mounted on said housing and positioned adjacent the opposite side edges of said second deck for receiving and gripping opposed side portions of the flat material and operative to move the portion of the flat material therebetween toward the rear of said second deck into overlying relation with the flat material adjacent said first fold to form at least second and third folds extending transversely of the flat material whereby a plurality of respective portions of the flat material are folded to be in face-to-face relation;

d. means mounted on said housing and positioned adjacent the rear edge of said second deck for engaging a center portion of the flat material having said first and second and third folds and moving same to form a center fold extending normal to the first and second and third folds, said means for engaging said center portion of the flat material comprising:

1. a bracket swingably mounted on said housing and positioned adjacent the rear edge of said second deck;

2. a pair of adjacent elongated rollers rotatably mounted on said bracket, said rollers extending substantially normal to the rear edge of said second deck;

3. means operatively connected to said bracket for selectively moving same and said pair of rollers thereon between a first position having said rollers extending normal to said rear edge of said second deck and in engagement with a center portion of the flat material having said first and second and third folds; and
4. means operatively connected to said pair of rollers on said bracket for turning same to move the flat material therebetween to form the center fold.

9. A flat material folding device as set forth in Claim 8 wherein each of said rollers on said bracket has a sleeve thereon formed of rubber material.

10. A flat material folding device comprising:

a. a housing having a first deck and a second deck and an entrance therebetween, said first deck being above said second deck and adapted to receive flat material thereon, said second deck having a front edge and a rear edge and opposite side edges;
b. means adjacent the front edge of said second deck for receiving an intermediate portion of the flat material and moving same from said first deck and through the entrance and over said second deck in a manner to form a first fold extending transversely of the flat material;
c. means mounted on said housing and positioned adjacent the opposite side edges of said second deck for receiving and gripping opposed side portions of the flat material and operative to move the portion of the flat material therebetween toward the rear of said second deck into overlying relation with the flat material adjacent said first fold to form at least second and third folds extending transversely of the flat material whereby a plurality of respective portions of the flat material are folded to be in face-to-face relation;
d. means mounted on said housing adjacent each of the opposite side edges of said second deck and engageable by said gripping and moving means to move same relatively outwardly for effecting tension in the flat material therebetween during the movement of the flat material to form said second and third folds;
e. resilient means in engagement with said gripping and moving means for resiliently maintaining same in engagement with said means for effecting tension in the flat material; and
f. means mounted on said housing and positioned adjacent the rear edge of said second deck for engaging a center portion of the flat material having said first and second and third folds and moving same to form a center fold extending normal to the first and second and third folds.

11. A flat material folding device as set forth in claim 10 wherein:

a. said means for receiving and gripping the flat material and moving same to form at least second and third folds includes:
   1. a pair of arms each positioned adjacent a respective one of the opposite side edges of said second deck, said arms each having one end thereof pivotally mounted on said housing and movable between a first position with the other end thereof adjacent the front edge of said second deck and a second position with the other end thereof adjacent the rear edge of said second deck; and
   2. material holding means for and mounted on the other end of each of said arms for selectively clamping and releasing a respective side edge portion of the flat material; and
b. said means for effecting tension in the flat material comprises a pair of cam surfaces each mounted on said housing and adjacent a respective one of the opposite side edges of said second deck and shaped to effect outward movement of said pair of arms during movement from said first position to said second position.

* * * * *